US005955385A

United States Patent [19]

Schobesberger et al.

[11] Patent Number: 5,955,385

[45] Date of Patent: Sep. 21, 1999

[54] RECYCLABLE WOVENS COMPOSED OF POLYOLEFIN YARNS

[75] Inventors: Claus Peter Schobesberger, Aschach/Donau; Günther Gleixner, Haag; Jürgen Ebel, Wels; Gerald Danner, Asten, all of Austria

[73] Assignee: Asota Gesellschaft m.b.H., Austria

[21] Appl. No.: 08/884,407

[22] Filed: Jun. 27, 1997

[30] Foreign Application Priority Data

Jun. 28, 1996 [AT] Austria ..... 1147/96

[51] Int. Cl.[6] ..... D03D 15/00; D06C 29/00; D06M 17/00

[52] U.S. Cl. ..... 442/59; 442/60; 442/79; 442/80; 442/82; 442/85; 442/104; 442/107; 442/164; 442/170; 442/171

[58] Field of Search ..... 442/59, 60, 79, 442/80, 82, 85, 86, 88, 91, 92, 104, 107, 170, 164, 171, FOR 100, FOR 101, FOR 121, FOR 128, FOR 148, FOR 165

[56] References Cited

U.S. PATENT DOCUMENTS

| | | | |
|---|---|---|---|
| 4,839,228 | 6/1989 | Jezic et al. | 428/401 |
| 5,662,978 | 9/1997 | Brown et al. | 442/401 |

FOREIGN PATENT DOCUMENTS

| | | |
|---|---|---|
| 0 607 933 | 7/1994 | European Pat. Off. . |
| 0 629 724 | 12/1994 | European Pat. Off. . |

*Primary Examiner*—Nathan M. Nutter
*Attorney, Agent, or Firm*—Wenderoth, Lind & Ponack, L.L.P.

[57] ABSTRACT

A recyclable textile sheet material for textile sun protection articles, tarpaulins, tent fabrics, canopy fabrics and the like comprises yarns or threads of polyolefin biconstituent fibers in combination with 0–50% by weight of polypropylene fiber in the warp and/or fill direction.

9 Claims, No Drawings

RECYCLABLE WOVENS COMPOSED OF POLYOLEFIN YARNS

Awning fabrics are at present produced with preference from polyacrylonitrile (PAN) threads in a 1:1 plain weave construction with a very high number of picks and ends per inch. The wovens have to be provided with a chemical finish to obtain the stiff hand required of awnings and water- and oil-repellent properties or adequate water tightness. The stiff-hand finishes used are melamine-formaldehyde resins and the oil- and water-repellent finishes used are fluorocarbon resins.

One disadvantage of the PAN wovens is that hitherto it has not been possible to find a suitable way to recycle PAN wovens. For this reason, not only the considerable production wastes from the making-up of the awning cloths and from edge trimming but also the used awnings have to be landfilled or incinerated.

Attempts are therefore underway to find highly UV-stable wovens, especially woven awning fabrics, which are recyclable. Wovens produced from polypropylene (PP) fine fibers without chemical finish are 100% recyclable and, on appropriate stabilization, have excellent UV stability, equivalent to that of PAN awning fabric wovens, and in addition possess improved breaking and tear strength and a lower permanent set than PAN wovens. However, these PP wovens do not achieve the required stiff hand without melamine-formaldehyde resin. Yet stiff-hand finishing with melamine-formaldehyde resin leads to an increased chalking effect. In addition, small amounts of amines are formed during recycling, for example during melting and repelletizing, as a result of thermal decomposition of the melamine-formaldehyde resins and confer a fishy odor on the repelletized product. Despite melt filtration, the unpleasant odor and, in addition, gel particles of crosslinked melamine-formaldehyde resin remain in the repelletized product, so that only up to about 30% of the repelletized product can be re-used in a mixture with virgin material.

EP-B1-0 629 724 claims to solve these problems by describing polyolefin wovens which have the desired stiff hand without melamine-formaldehyde resins. The yarns used therein comprise a blend of PP fibers and lower melting bonding fibers, the proportion of the lower melting bonding fiber varying between 1–20% by weight.

The disadvantages of these wovens are that it is prohibitively costly to produce a homogeneous fiber blend and that the ready-finished wovens tend to form undesirable light-colored streaks at the creases. This tendency increases with increasing proportion of lower melting bonding fiber.

It is an object of the present invention to avoid the above-described disadvantages of stiff-hand finishing and to find an efficiently recyclable fabric which also has improved rebound elasticity, i.e. rapid recovery from creasing or wrinkling.

This object is unexpectedly achieved when, instead of yarns composed of a mixture of PP fibers and lower melting fusible bonding fiber, yarns composed of specific biconstituent fibers are used as fill and/or warp yarn to produce the fabric.

The present invention accordingly provides a recyclable textile sheet material for textile sun protection articles, tarpaulins, tent fabrics, canopy fabrics and the like, comprising yarns or threads of polyolefin biconstituent fibers in combination with 0–50% by weight of polypropylene fiber in the warp and/or fill direction.

Biconstituent fibers composed of PP with varying levels of PE and the production thereof are described in U.S. Pat. No. 4,839,228 for example.

The polyolefin biconstituent fibers used according to the invention comprise a finely disperse mixture of polypropylene and 40 to 60% by weight of a lower melting thermoplastic which is not miscible with polypropylene. Polypropylene (PP) is to be understood as meaning isotactic or syndiotactic propylene with or without the customary proportions of atactic PP from the production process.

Preference is given to using syndiotactic or isotactic PP having a very high tacticity and thus very crystalline polypropylene.

Examples of suitable lower melting thermoplastics which are not miscible with PP are polyethylene, copolyamide or copolyester. Preference is given to using PP-immiscible thermoplastics which have a melting point between about is 70 and 150° C. Particular preference is given to using polyethylene (PE) as lower melting thermoplastic. Polyethylene (PE) can be used in the form of low density polyethylene (LDPE), high density polyethylene (HDPE) and linear low density polyethylene (LLDPE). Preference is given to using LLDPE or HDPE.

LLDPE can include 1 to 20% by weight of at least one α-olefin alkylene having 3 to 12, preferably 4 to 8 carbon atoms.

According to the present invention, polyolefin biconstituent fibers composed of PP and 40 to 60% by weight of lower melting thermoplastic not miscible with PP are used for producing the textile sheet materials. The proportion of lower melting thermoplastic is preferably between 45 and 58% by weight, particularly preferably between 50 and 55% by weight.

The sheet materials of the invention can be 100% composed of yarns or threads of biconstituent fibers. However, the proportion of biconstituent fibers can also be replaced with PP fibers up to a proportion of 50%. The PP fibers used in this case can be isotactic, syndiotactic and atactic PP as described above. Preference is again given to using iso- and syndiotactic PP.

The PP and biconstituent fibers used comprise customary assistants and have to have in particular high UV stability and color fastness, especially weather fastness. Examples of assistants are UV stabilizers, thermostabilizers and pigments.

Examples of suitable UV stabilizers are polymeric hindered amine light stabilizers (HALS) or mixtures of various HALS stabilizers.

Suitable pigments are organic and inorganic pigments which have the required high weather fastness and do not adversely affect the UV stability.

To produce the sheet materials of the invention, the first step is to produce yarns or threads from staple fibers or multifilaments having the required high UV stability, color fastness and weather fastness. To this end, the above-described assistants are added to the polymer at melt spinning.

In accordance with the desired yarn or thread linear density, it is possible to use PP fibers and biconstituent fibers having different fiber or filament linear densities. Preference is given to using fibers having a linear density between 1.5 to 5 dtex, particularly preferably between 1.7–3 dtex.

Producible yarn linear densities vary over a wide range. Preference is given to producing yarns having a linear density of metric count Nm 20–Nm 60. The yarns thus obtained are then optionally twisted in the conventional manner, for example according to the two-for-one process or some other suitable process, and then processed in a conventional manner to form the textile sheet material of the invention. The textile sheet material is preferably a woven fabric.

If, for certain applications, it is necessary for the yarns or threads to have an increased tenacity, up to 50% of PP fibers can be admixed into the yarns or threads to increase the tenacity. This can be done by making the yarn from a blend of PP fibers and biconstituent fibers in the first place, or by forming the thread, for example by 2-fold twisting, from a 100% PP yarn and a 100% biconstituent fiber yarn.

After the customary washing of the woven or textile sheet material to remove the spin finish and any twisting finish, the woven or textile sheet material is additionally provided only with a finish which confers oil and water repellency. Fluorocarbon resins are preferably used for this purpose.

To cure the fluorocarbon resin, the woven or textile sheet material is heated to a temperature above that of the melting point of the lower melting component of the biconstituent fiber, causing the biconstituent fibers to adhere to each other and to any PP fibers present. After cooling, this leads to the desired stiff hand coupled with good rebound elasticity.

Depending on the yarn or thread linear density used and the weave construction used (e.g. weave design or number of warp and fill threads/cm), the desired stiff hand and the rebound elasticity are achieved using yarns or threads of the above-described biconstituent fiber in warp and fill or only in warp or fill.

The thermal treatment of the fabric, given suitable temperature control, will result in significantly smaller changes in the color (the depth of color, specifically) compared with the prior art. At the same time, the appearance of light-colored streaks on creasing or wrinkling is substantially avoided as a result.

A further advantage is that the woven or textile sheet material can be produced without the costly intermediate stage of a homogeneous blend of, for example, PP fibers with PE fibers without sacrificing the good recyclability.

The resulting wovens or sheet materials are thus particularly useful for manufacturing textile sun protection articles, preferably awnings, but also for boat covers, tent sheets, camping furniture covers and the like.

Example 1

Nm 34 and Nm 50 yarns were each spun on a three-cylinder ring-spinning machine from 100% PP staple fibers of the type ASOTA FV8817, 2.2 dtex, 50 mm cut length (highly UV-stable, spun-dyed, ultimate tensile stress strength 46 cN/tex, ultimate tensile stress extension 32%) and also 100% of a specific biconstituent fiber of the type ASOTA FV4508 (50% of PP, 50% of PE), 2.2 dtex, 50 mm cut length (highly UV-stable, ultimate tensile stress strength 38 cN/tex, ultimate tensile stress extension 36%). The yarns were twisted to Nm 34/2 and Nm 50/2 thread by the two-for-one process.

| | Yarn data cN/tex | Extension % |
|---|---|---|
| FV8817 | | |
| Nm 34/2 | 33.8 | 20.4 |
| Nm 50/2 | 31.9 | 21.2 |
| FV4508 | | |
| Nm 34/2 | 27.5 | 25.1 |
| Nm 50/2 | 26.3 | 26.0 |

The Nm 34/2 and Nm 50/2 threads produced from ASOTA type FV8817 were used for the warp ends.

The Nm 34/2 and Nm 50/2 threads produced from ASOTA type FV4508 were used as fill yarn.

The fabrics were produced in a 1:1 plain weave construction on a Sulzer projectile weaving machine using 30 ends/cm, 14.5 picks/cm for Nm 34/2 thread and i6 ends/cm and 17 picks/cm for Nm 50/2 thread.

The wovens thus produced were washed in the presence of 1 g/l of Ladiquest 1097 to remove the spin and twisting finish and then rinsed. For soil and water repellency, the wovens were finished with the following recipe by the pad-mangling process (wet pickup about 50%):

| | |
|---|---|
| Catalyst CR | 5 g/l |
| Nuva FPT | 50 g/l |
| Drying | 3 min. 100° C. |
| Curing | 3 min. 140° C. |

The ready-finished wovens had the desired stiff hand coupled with good rebound elasticity.

In the case of the wovens produced from Nm 34/2, the DIN 53857 ultimate tensile stress strength was 264 daN/5 cm in the warp and 125 daN/5 cm in the fill direction and the ultimate tensile strength extension was 54% and 22%, respectively. The DIN 53886 watertightness was 32 mbar.

In the case of the wovens produced from Nm 50/2, the DIN 53857 ultimate tensile stress strength was 198 daN/5 cm in the warp and 100 daN/5 cm in the fill direction and the ultimate tensile stress extension was 53% and 23%, respectively. The DIN 53886 watertightness was 30 mbar.

The wovens thus produced met all the awning cloth requirements, the stiff hand and here especially the rebound elasticity being distinctly improved over PAN wovens and the wovens described in the reference EP-B1-0 629 724. Also, the appearance of light-colored streaks on creasing or wrinkling is substantially avoided as a result.

The wovens are easy to repelletize. The repelletized product is 100% usable for producing polyolefin staple fibers.

What is claimed is:

1. A recyclable woven textile sheet material, comprising yarns or threads of polyolefin biconstituent fibers in combination with 0–50% by weight of polypropylene fiber in the warp and/or fill direction.

2. The recyclable woven textile sheet material of claim 1, wherein the polyolefin biconstituent fibers comprise a finely disperse mixture of polypropylene and 40 to 60% by weight of a lower melting thermoplastic which is not miscible with polypropylene.

3. The recyclable woven textile sheet material of claim 2, wherein the lower melting thermoplastic which is not miscible with polypropylene is polyethylene, copolyamide or copolyester.

4. The recyclable woven textile sheet material of claim 2, wherein the lower melting thermoplastic is polyethylene.

5. The recyclable woven textile sheet material of claim 1, wherein the fibers further comprise UV stabilizers, thermostabilizers and pigments.

6. The recyclable woven textile sheet material of claim 1, comprising an oil- and water-repellent finish.

7. The recyclable woven textile sheet material of claim 6, wherein the oil- and water-repellent finish comprises a fluorocarbon resin.

8. The recyclable textile sheet material of claim 1, comprising a woven fabric.

9. In a method for manufacturing an awning from an awning fabric, the improvement which comprises employing the recyclable woven textile sheet material of claim 1 as the awning fabric.

* * * * *